United States Patent [19]

Burns

[11] 4,153,247

[45] May 8, 1979

[54] EQUAL TENSIONED GAME NET ASSEMBLY

[76] Inventor: Everett M. Burns, 8580 W. 45th Ave., Wheatridge, Colo. 80033

[21] Appl. No.: 852,490

[22] Filed: Nov. 17, 1977

[51] Int. Cl.[2] ..... A63B 69/00

[52] U.S. Cl. ..... 273/29 BC

[58] Field of Search ..... 273/29 R, 29 BB, 29 BC, 273/29 BD, 29 BE, 95 R; 248/295 R; 211/119

[56] References Cited

U.S. PATENT DOCUMENTS

| | | | |
|---|---|---|---|
| 2,638,346 | 5/1953 | Stapleton | 273/29 BB |
| 3,065,964 | 11/1962 | Barnes | 273/29 BB |

OTHER PUBLICATIONS

"Jayfro Tennis Equipment" p. 17, 2/28/76.

*Primary Examiner*—Richard C. Pinkham
*Assistant Examiner*—T. Brown
*Attorney, Agent, or Firm*—Jack C. Sloan

[57] ABSTRACT

A game net assembly for raising and lowering game nets to proper elevations by a tensioning ratchet positioned away from the playing area. The tensioning ratchet is affixed to a floating sleeve and hence is capable of putting the same tension on the upper and lower net cables. The net cables are received by the tensioning ratchet through the passageway created by mounting two uprights in parallel between a base plate and a top plate. A channel is slidably mounted for vertical movement along the rear side of the uprights and has a sleeve guide for receiving the sleeve affixed to a floating tensioning ratchet.

9 Claims, 6 Drawing Figures

EQUAL TENSIONED GAME NET ASSEMBLY

BACKGROUND OF THE INVENTION

This invention relates to game net assemblies such as those used in badminton, tennis and volley-ball. More particularly this invention relates to apparatus for erecting, stretching and adjusting such nets at specified elevations under uniform tension while providing for a high degree of player safety.

Problems associated with game net assemblies have been intensified by recently promulgated rules governing formal competition play. For example, current Internation Volley-Ball Association rules call for equal tension on the net's upper and lower cable extensions with no more than one-quarter inch of vertical sag at the center of the net. The physical forces required to meet such standards are beyond the mechanical strength of many existing game net assemblies. Bent mounting posts are perhaps the most common physical evidence of unsuccessful attempts to meet the one-quarter inch net sag rule. At best, getting the proper net elevation and tension with the prior art game net assemblies usually involves a process of repeated tying and untying of the top and bottom cables on the end of the net opposite the tensioning means and/or changing the cable length at the tensioning means end of the net assembly.

Additionally, the prior art game net assemblies such as those taught in U.S. Pat. Nos. 2,638,346 and 3,065,964 are characterized by having their pulleys and/or tensioning means positioned on the game net side of the mounting posts. This position invites accidental player contact with the protruding features of these devices such as ratchet teeth, lever arms and pulley wheel edges. Furthermore, the erection and disassembly of many existing game net assemblies is complicated and requires more than two people to safely accomplish.

SUMMARY OF THE INVENTION

The applicant's invention overcomes the above described problems and disadvantages in the following manner. A game net is stretched between upper and lower cable extensions which span between a hooking means mounting post and a tensioning means mounting post. The mounting posts are each constructed from two parallel uprights rigidly affixed between a base plate and a top plate to create a vertical passageway between the uprights for receiving the upper and lower cable extensions of the game net. The passageway is wide enough to allow each cable to extend through the passageway from the front side of the uprights facing the game net to the rear side of the uprights to a tensioning means which is also located on the rear side of the mounting posts away from the game net. The vertical passageway allows the upper and lower cable extensions to be raised or lowered along the entire vertical distance of the passageway while the extension cables are still attached to the net. Thus the net may be easily raised or lowered to regulation volley-ball, badminton, or tennis elevation. Furthermore, with the exception of the cables themselves the front surfaces of the uprights present a flat, easily padded surface with no protruding apparatus such as pulleys or ratchets with which the players might accidentally collide. Preferably easily removable padding material is used to cover the front three sides of the mounting posts from the floor to about seven feet.

The most important feature of the mounting post is that it is bifurcated into two upright elements. This not only provides the vertical passageway but also imparts overall strength to the mounting post element. The uprights may be made of any suitably rigid material and be of any common cross sectional shape such as round, square or rectangular. However, for practical reasons associated with weight, ease of fabrication, strength and costs, applicant prefers to make the uprights from members whose cross sections appear as hollow rectangles such as those commonly marketed in 1"×3" gauge steel.

A guide cable holder is located at the top of the mounting post on top of the top plate. This holder can also be of several shapes and materials. A 90° angle shaped piece such as a 2"×2"—90° angle, 14 gauge steel piece which is about 12" long is preferred however, the 90° angle is preferably abutted on both the top plate and the front sides of the uprights. The horizontal portion of the guide cable holder which abuts the top plate should not extend beyond the rear edge of the uprights since this would interfere with the vertical movement of other hereinafter described elements of this invention such as slidably mounted channels nad tensioning means. The guide cable holder can be attached to the mounting post in a number of ways but applicant prefers that this be done by means of a bolt extending through the horizontal portion of the 90° angle to a hole located in the top plate. The holes should be so arranged that the guide cable holder can only be located on the front side of the upright.

The base plate for the uprights can be flat or have toe pieces of known design which are specifically adapted for insertion into anchoring holes located in gymnasium floors.

Channels are slidably mounted for vertical movement along the rear side of the tensioning means mounting post and the hooking means mounting post. Preferably the width of the channel trough is slightly greater than the combined width of the two uprights and the passageway between them so that the trough of of the channel can slide along the rear side of the uprights and the sides of the channel can slide along the rear outside portions of the uprights.

Applicants have found that 12 gauge steel channels having a 3"×1½" trough well suited for use in this invention.

The thus slidably mounted channels are provided with one or more locking means for holding the channels to the uprights at desired elevations. Preferably the locking means comprises an operation knob located on the rear side of the mounting posts, a holding element which can be a channel section located on the front side of the uprights and a tightening connecting element such as a bolt which fits in the vertical passageway between the uprights so that the tightening connector element has freedom of vertical movement in the passageway when the locking means is loosened.

A tensioning means channel is mounted on the upper rear side of the tensioning means mounting post. The tensioning means channel governs the height of the net. This channel has an upper roller means such as a pulley for directing the upper cable extension from the horizontal to the downward vertical and a lower roller means for directing the lower cable extension from the horizontal to the upward vertical. The pulleys could be mounted at the top and bottom edges of the vertically positioned tensioner channel. However, for reasons of strength, durability and improved operation applicants prefer that the tensioning means channel be provided with an upper and a lower hole. The upper hole is for mounting brackets for the upper pulley and through which the upper cable's direction is converted from the horizontal to the vertical. Similarly a lower hole is provided for a lower pulley. Thus the pulleys are sandwiched in the passageway and present no protruding features to the playing area. The tensioner channel is also provided with a sleeve guide which is fixedly mounted along the rear side of the channel for slidably receiving a sleeve along the length of the sleeve guide. The sleeve guide runs substantially between the upper and lower pulley holes.

A tensioning means such as a ratchet, windlass, jack or motor is affixed to the rear side of a sleeve. The front side of the sleeve is adapted to fit around the channel's sleeve guide so that the sleeve can move vertically along the sleeve guide. The tensioning means is adapted to change the direction of one of the cable extensions with respect to the direction of the other cable extension upon actuation of the tensioning means. Preferably the upper cable extension is pulled down while the lower cable extension is pulled up. Therefore actuation of the tensioning means puts an equal force on the upper and lower cable extensions which in turn produces a desirable uniform tension on the upper and lower ends of the game net itself. This uniform tensioning occurs because the tensioning means is affixed to the sleeve which is free to slide vertically along the sleeve guide of the channel. The tensioning means channel is set at a given elevation to give a certain net elevation. Thus the operation of the tensioning means gives a uniform tension on the upper and lower extension cables regardless of the tensioning means channel elevation. In other words, the tensioning means "floats" when the force on the upper extension cable equals the force on the lower extension cable. Furthermore, one of the most potentially injurious elements of a game net assembly, the tensioning means with its protruding lever arms, ratchet teeth etc. is removed from the playing area and placed behind the padded mounting post.

Similarly a channel is located on the outside of the uprights under the tensioner channel. This channel may also be slidably mounted for vertical movement and may also have locking means such as those to hold the tensioning means channel at some specified elevation. A rolling means such as a truck or dolly is affixed to the rear side of this channel which will hereinafter be referred to as the truck channel. The purpose of the truck is to hold the mounting post in a nearly upright position during assembly without the aid of a co-worker. The truck used in this invention is particularly characterized by the fact that the side of the truck attached to the truck channel is held higher away from the floor than the side of the truck away from the truck channel. This is done by means of a truck toe piece. The difference in elevation at the opposite end of the truck causes the mounting post to tilt away from the game net during preliminary assembly. This helps to support the net's weight during assembling stages prior to final tightening of the assembly by operation of the tensioning means. This feature greatly facilitates game net assembly by one person. It will be appreciated that the toe piece of the truck could optionally be sunk into an anchoring hole in the gymnasium floor. As the tensioning means pulls the net tight the mounting post is pulled to a full upright position and the rear end of the truck tends to be lifted from the gymnasium floor. When the net is loosened the rear end of the truck returns to the floor. Preferably the truck is a tripod having rollng means at the two corners away from the truck channel.

Similarly a tripod based referee's stand is attached to a vertically adjustable channel, hereinafter referred to as the referee's stand channel, which is slidably mounted to the outside of the hooking means mounting post which supports the other side of the net. The referee's stand is also adapted by an elevated toe piece to tilt away from the net during the assembly stages prior to final tightening of the tensioning means. As in the case of the truck, the rear wheels of the referee's stand tend to be lifted from the floor upon full tensioning of the game net assembly. The referee's stand also has appropriate locking means for holding the referee's stand at desired elevations for referee observation of the game.

Slidably mounted above the referee's stand channel is a slidably mounted locking means channel. This channel has hooks affixed to it on its inside so that the hooks are safely recessed in the vertical passageway formed by the two uprights which form the hooking means mounting posts. The upper and lower extension cables are attached to these hooks. The hooking means channel is equipped with at least one locking means for holding the hooking means channel, and hence the net, at some desired elevation.

The hooking means mounting post is provided with a guide cable holder similar in all its important features to the guide cable holder used on the tensioning means mounting post.

The most important feature of the guide cables themselves is the foot-shaped anchor used to attach the four or more guide cables to the four or more cable receptacles located in the gymnasium floor. The shape of the foot-shaped anchor is related to the shape of the cable receptacle in such a way that the foot-shaped anchor must be put in and taken out of the receptacle at a particular angle.

This feature greatly facilitates assembly by one person in that it prevents the accidental unhooking of guide cables which often occurs with the use of U-shaped anchor hooks. It is also contemplated that the guide cables will also be provided with turnbuckles for making small adjustments in each guide cable's length.

This invention possesses many other advantages, and has other purposes which may be made more clearly apparent from a consideration of a form in which it may be embodied. This form is shown in the drawing accompanying and forming part of the present specification. It will now be described in detail, for the purpose of illustrating the general principles of the invention; but it is to be understood that such detailed description is not to be taken in a limiting sense, since the scope of the invention is best defined by the appended claims.

DESCRIPTION OF THE PREFERRED EMBODIMENT

Figure 1:
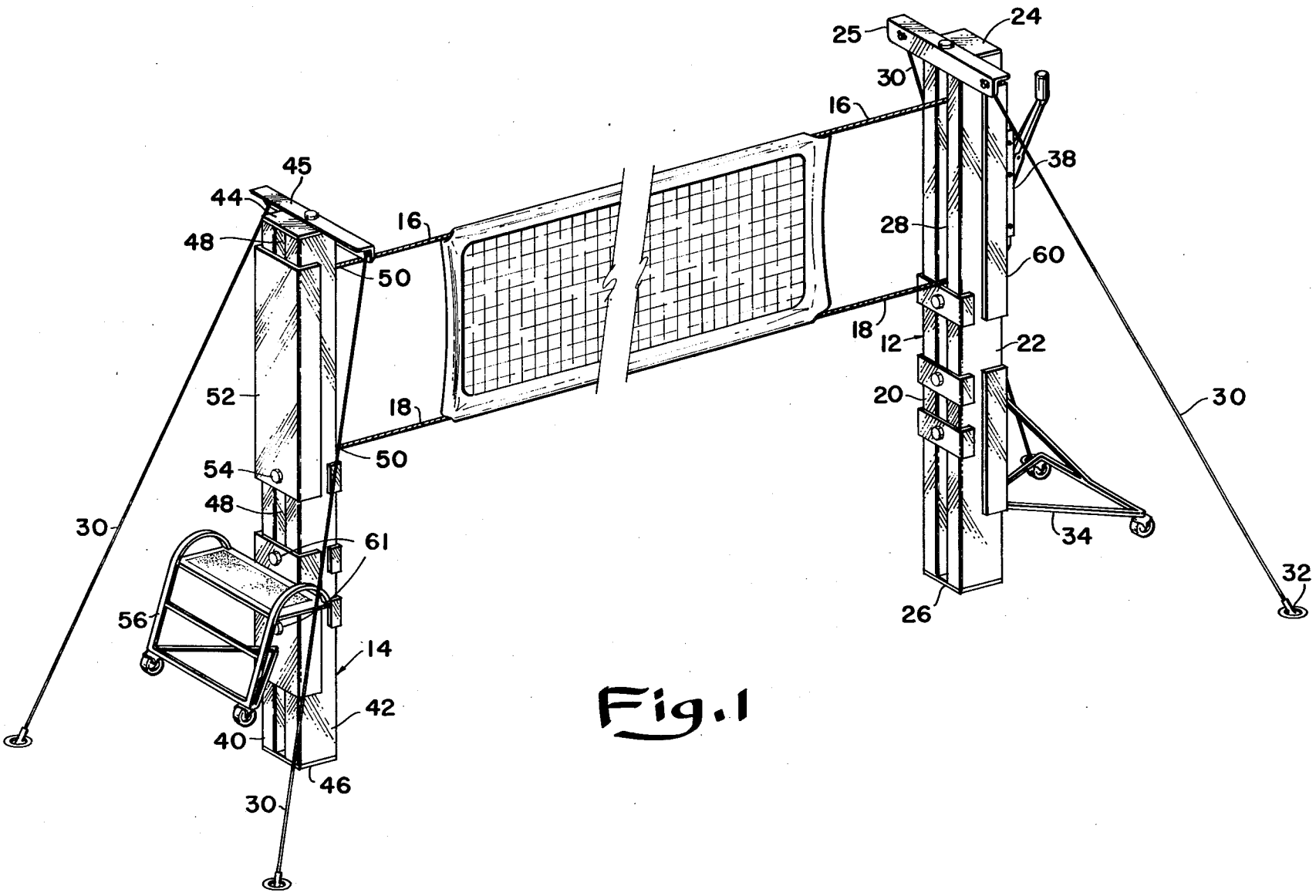
FIG. 1, is a diagrammatic perspective view of a volley-ball court with a game net assembly supported in accordance with this invention.

As seen in FIG. 1, the illustrative embodiment of the invention is applied to a volleyball net 10 stretched between a tensioning means mounting post 12 a hooking means mounting post 14. As customary, the net 10 is supported by an upper extension cable 16 and a lower extension cable 18. The tensioning means upright 12 comprises a left standard 20 and a right standard 22 mounted in parallel between a top plate 24 and a base plate 26 to form a vertical passageway 28 between the left standard 20 and the right standard 22 through which the upper extension cable 16 and the lower extension cable 18 extend to pulleysnot shown in FIG. 1. The top plate 24 is capped with a guide cable holder 25 which is attached to guide cable wires 30 which are in turn attached to the floor by foot-shaped anchors 32. The lower part of the tensioning means upright 12 is attached to an auxiliary truck 34 to enable the assembler to set up the net assembly alone. A slidable channel 36 as well as a tensioning means 38 slidably mounted to the channel 36 are shown on the rear side of the upright 12. A hooking means mounting post 14 comprises a left standard 40 and a right standard 42 mounted between a top plate 44 and a base plate 46 not drawn in FIG. 1 to form a verticle passageway 48 through which the upper extension cable 16 and the lower extension cable 18 extend to hooking means 50 attached to a slidably mounted channel 52 having locking means 54. A guide cable holder 45 is located on top of the top plate 44 at the front side of the hooking means mounting post 14. The hooking means mounting post 14 also has a referee's stand 56 affixed to a slidably mounted channel 58 having locking means 61. The referee's stand 56 tilts away from the net 10 when lowered to the floor to aid one person to erect the game net assembly. The top plate is provided with a hole for mounting a guide cable holder 45.

Figures 2, 5:
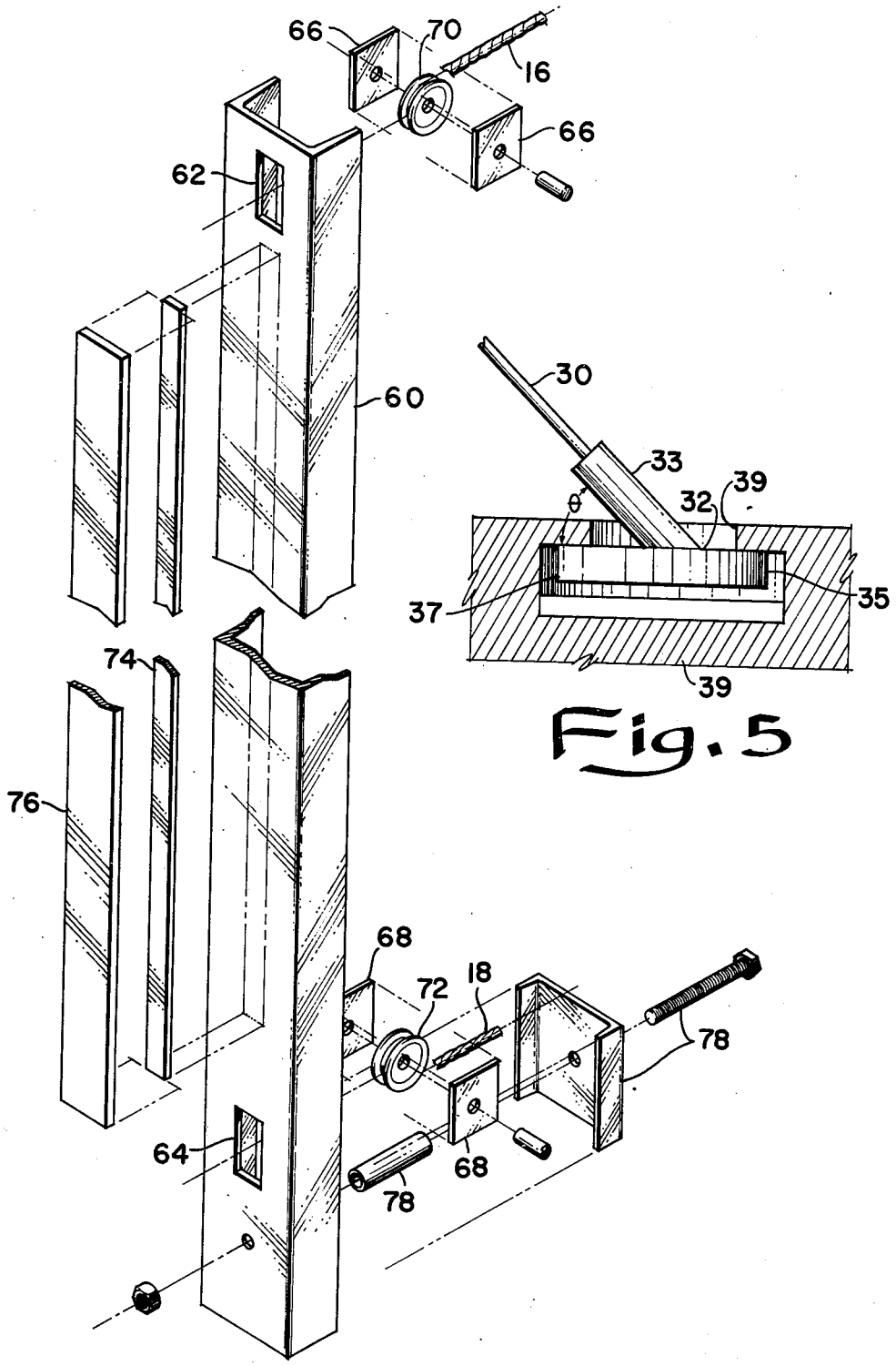
FIG. 2, is an exploded perspective view of the tensioning means channel and its associated parts.
FIG. 5, is a perspective view of an illustrative guide cable holder.

FIG. 2, shows an illustrative embodiment of a tensioning means channel 60 associated with the tensioning means upright 12 not shown. The channel 60 has an upper hole 62 and a lower hole 64 for mounting pulley brackets 66 and 68 through which the upper extension cable 16 and the lower extension cable 18 pass. The upper pulley 70 is positioned in its bracket 66 so as to protrude through the upper hole 62 so that the upper cable extension 16 is directed from the horizontal on the front side of the channel to the vertical on the rear side of the channel by action of the upper pulley 70. Similarly to lower cable extension 18 is directed from the horizontal to the vertical by action of the lower pulley 72. An inside strip 74 is affixed to the rear side of the channel 60 and an outside strip 76 is in turn affixed to the inside strip 74 to form a guide for receiving a sleeve along the length of the guide. The channel 60 is also provided with a locking means 78 for locking the channel 60 at a specified elevation with respect to the upright 12.

Figure 3:
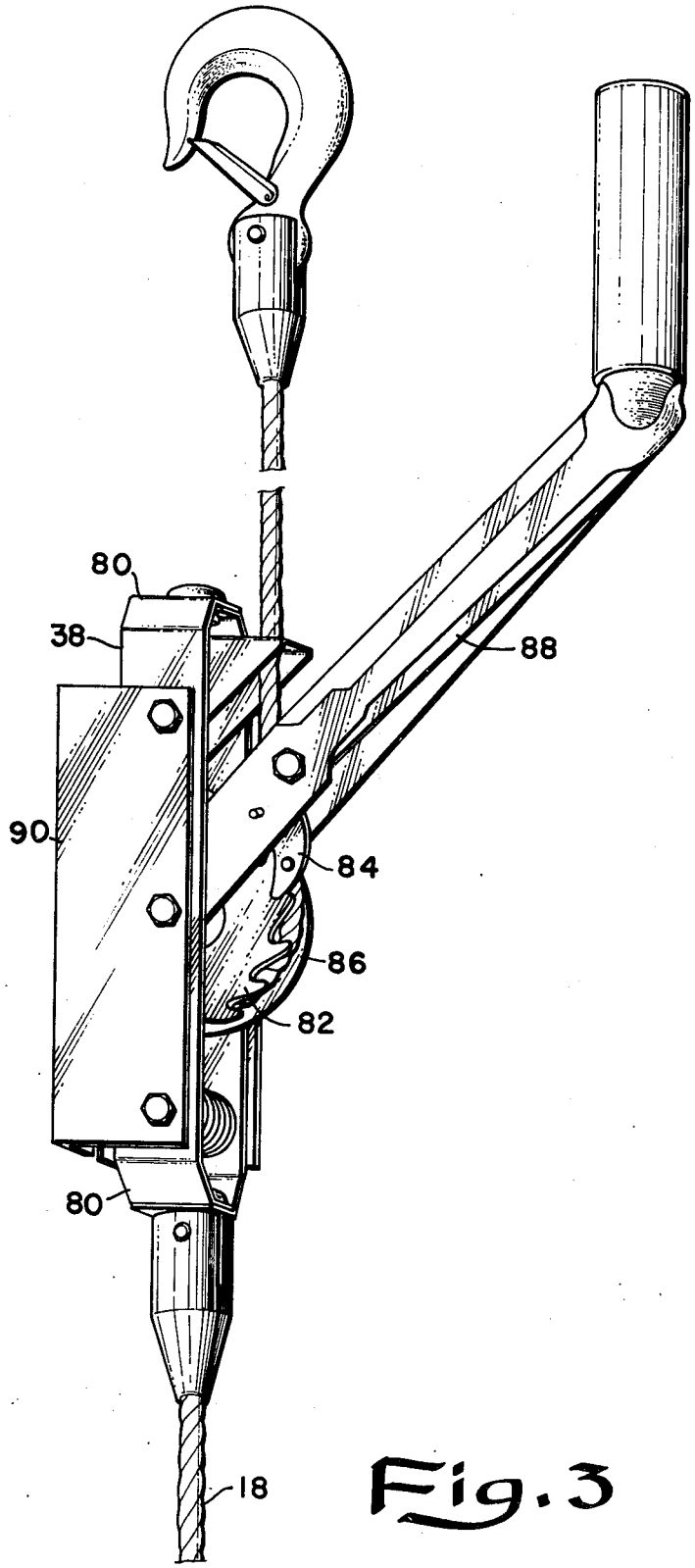
FIG. 3, is a perspective view of an illustrative tensioning means such as a winch showing the sleeve to which the tensioning means is affixed.

FIG. 3, is an illustrative tensioning means 38 shown in perspective view. The tensioning means is slidably mounted to the rear of the channel 60 and comprises a housing 80 for a ratchet 82 and pawl 84. The ratchet 82 is affixed to a cable take-up reel 86 around which the upper cable extension 16 winds. The lower cable extension 18 is attached to the lower end of the housing 80 so that the direction of the upper cable extension 16 is opposed to the direction of lower cable extension 18 upon operation of the lever arm 88 attached to the ratchet 82. The housing 80 is provided with a sleeve 90 adapted to fit around the outside strip 76 of the guide located on the tensioning means channel 60.

Figure 4:
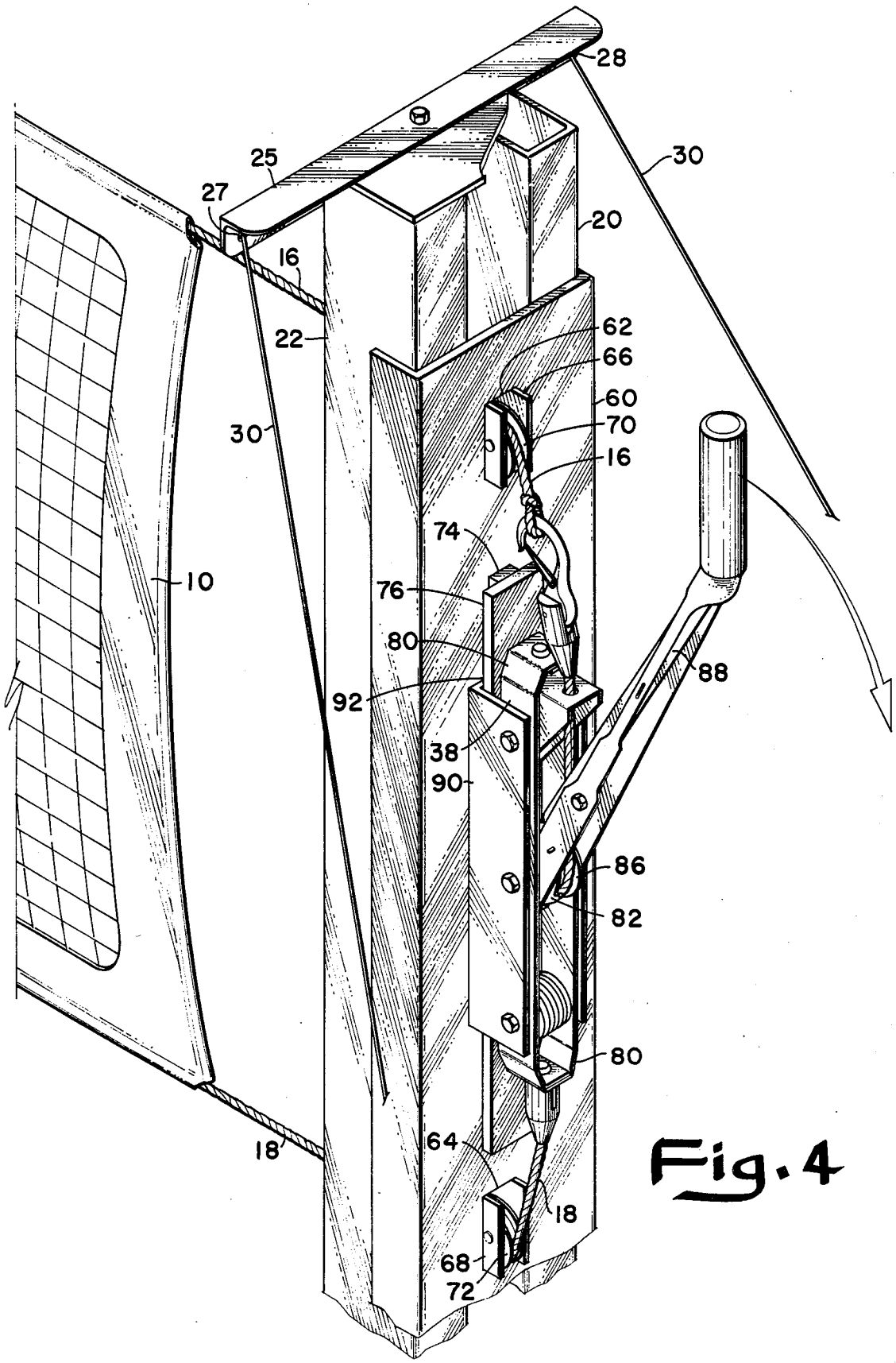
FIG. 4, is a top sectional view of the tensioning means associated with the mounting post.

FIG. 4, is a top view of the tensioning means mounting post 12 of the assembly. The tops of the standards 20 and 22 are depicted as two parallel rectangles. The top plate 24 is shown in outline form only. The guide cable holder 25 is shown fixedly abutting the front sides of the standards 20 and 22 as well as the top of the top plate 24. The guide cable holder 25 has holes 27 and 29 for receiving guide wires 30 not shown. The channel 60 is shown positioned on the rear sides of the standards 20 and 22. The upper extension cable 16 is shown wrapped around the upper pulley 70 which protrudes through the upper hole 62. The sleeve 90 attached to the tensioning means housing 80, is positioned around the outside strip 76 which is affixed to the inside strip 74 which is in turn affixed to the channel 60 to provide vertical slots 92 for receiving the sleeve 90 for vertical slidable motion.

FIG. 4 also shows illustrative guide cable holder 25 fashioned from a 14 gauge steel 2"×2", 90° angle. The angle is fitted in the 90° angle formed by the front side of the tensioning means mounting post 12 and top plate 24. The vertical portion of the guide cable holder 25 has holes such as hole 27 at each end for receiving guide cables such as guide cable 30. The horizontal portions of the guide cable holder has a tapped hole for receiving a bolt used to hold the guide cable holder 25 to the top of the plate 24.

FIG. 5, illustrates a foot-shaped anchor hook 32 positioned in an anchor hook receptacle 39 located in a gymnasium floor. The anchor hook 32 is attached to a guide cable 30 at an ankle section 33. A toe 35 and a heel 37 are affixed to the ankle section 33 at an angle $\theta$ which can be from about 30 to about 60 degrees. More preferably the angle $\theta$ will be about 45 degrees. The length of the toe 35 and the heel 37 are such that the foot-shaped anchor 32 will only fit into the hole of the anchor receptacle 39 when the foot-shaped anchor hook 32 is angulated as shown in the second view of FIG. 6. This angulation requirement prevents accidental unhooking of the guide cables 30 during assembly. This feature facilitates assembly by one person.

Figure 6:
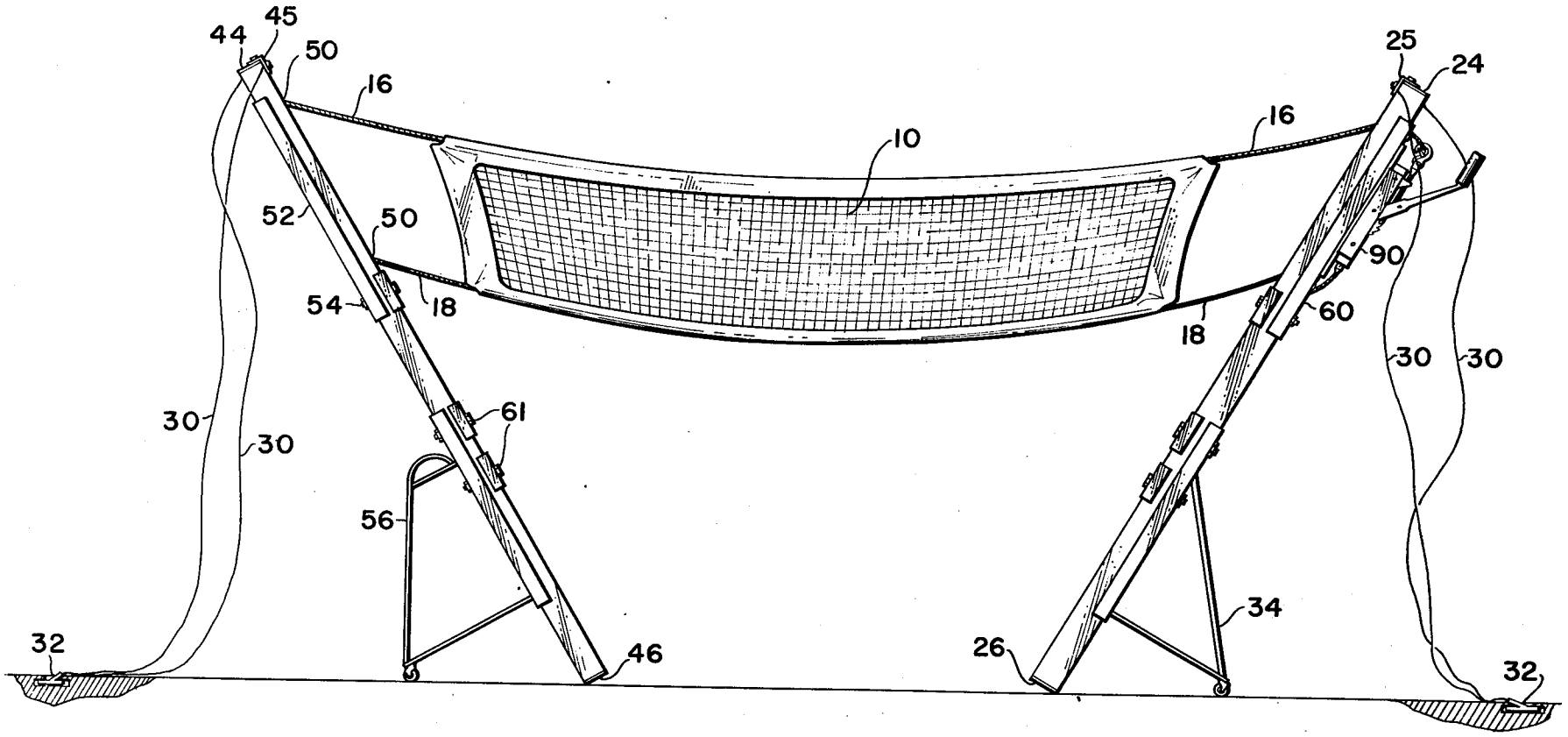
FIG. 6, is a side view of the game net assembly in the assembled state just before final tightening operations.

FIG. 6 is a side view of the game net assembly in the assembled state just prior to final tightening operations. The truck 34 tilts the tensioning means mounting post 12 away from the net because the truck 34 has been slid upward on, and affixed to, the mounting post 12 so that the weight of the sleeve 90 and its associated parts tilts the mounting post 12 as shown and thereby supporting the then sagging game net assembly 10.

The hooking means mounting post 14 is tilted in a similar fashion by the referee's stand 56. The height of the tensioning means channel 60 and the hooking means channel 52 have been set to a desired elevation by use of the locking means 78 and 54. This elevation will in turn govern the elevation of the net 10. Tightening of the tensioning means 38 will bring the mounting posts 12 and 14 to the full vertical taut position. The net cable extensions 16 and 18 are pulled in by the tensioning means 38 to take the sag out of the net 10. In the upright position the tension on the now tensioned cables 30 are pulling against the net cable extensions 16 and 18. The floating capability of the tensioning means 38 will automatically put the upper and lower cable extensions 16 and 18 in equal tension to complete the assembly process.

Having thus diclosed my invention I claim:

1. A game net support post assembly comprising; first and second, spaced apart, vertically extending, net support posts, said first support post comprising; two vertically extending and parallel post members, said post members being held in a spaced apart position by a top plate and a bottom plate, each of said plates being attached to respective upper and lower ends of said post members, said space between said post members being functional in defining a horizontal passageway between said post members; a net, said net having upper and lower net supprt cable extensions extending from its ends; an elongated channel member, said channel member having a length less than said post members and being slidably mounted on one of its sides for vertical movement on one side of said post members and spanning said passageway; means for locking said channel member on said post members in a parallel relationship thereto and at a desired elevation; said channel member having an opening adjacent to its respective upper and lower ends and a pulley being mounted in each of said openings and in said passageway between said post members; a sleeve guide; said sleeve guide being fixedly attached to said channel member on the side opposite said one side thereof; net tensioning means; said net tensioning means having a sleeve attached thereto, said sleeve slidably receiveing said sleeve guide and adjustably attaching said net tensioning means to said channel member;

One end of said net having said cable extensions attached to said second post and each of said upper and lower cable extensions at the other end of said net respectively extending from the side opposite said one side of said post member through said upper and lower openings, respectively trained over said upper and lower pulleys of said first post; said upper pulley directing said upper cable extension downwards and said lower pulley directing said lower cable upwards, each of said cables being subsequently attached to said net tension means, said net tensioning means being adapted to move said cables in opposite directions while being slidably displaced on said sleeve guide and relative to said post members for uniformly tensioning said cables.

2. The game net support assembly as defined in claim 1 wherein said second support post comprises two vertically extending and parallel post elements, said post elements being held in a spaced apart position by a top plate element and a bottom plate element, each of said plate elements being attached to respective upper and lower ends of said post elements, said space between said post elements being functional in defining vertical passageway between said post elements; an elongated channel element, said channel element having a length less than said post elements and being slidably mounted on one of its sides for vertical movement on one side of said post elements and spanning said passageway, means for locking said channel element on said post elements in a parallel relationship thereto and at a desired elevation; means for attaching said upper and lower cable extensions at said one end of said net to said channel element, said cable extensions being extended through said passageway prior to said attaching.

3. The game net support assembly as defined in claim 2 wherein said first and second support posts are provided with a pair of guide cable wires and a guide cable attachment means fixedly attached at the upper end of each of said support posts, each of said guide cables having one of its ends attached to said guide cable attachment means, extending downwardly and outwardly from said supprt post and having its other end provided with anchor means to anchor said guide cable to a support surface attached anchor receptacle to thereby stabilize each of said support posts.

4. The game net support assembly of claim 3 wherein the tensioning means is a hand levered ratchet.

5. The game net support assembly as defined in claim 3, wherein a frame having wheels is attached to each of said first and second support posts means for adjustably connecing said frame at fixed vertical locations on each said support post such that said wheels will touch the support surface adjacent the lower end of each support post, said support posts being stabilized by said wheels and frame.

6. The game net support assembly as defined in claim 5, wherein there are two wheels attached to each said frame, said wheels being spaced apart whereby said wheels and the bottom of a respective support post presents a tripod support base for said support post.

7. The game net support assembly as defined in claim 3, wherein, said second support post has an additional channel element slidably attached to the lower end thereof and means for fixedly positioning said additional channel element at different elevations on said second support post; a referees stand; said stand being affixed to said additional channel element.

8. The game net support assembly as defined in claim 7, wherein said stand is supported above the support surface so as to allow said support post to be tilted in a direction away from said net.

9. The game net support assembly as defined in claim 3, wherein said anchor means is an anchor hook and is adapted for insertion and withdrawal from said anchor receptacle.

* * * * *